US009731337B2

(12) United States Patent
Jang et al.

(10) Patent No.: US 9,731,337 B2
(45) Date of Patent: Aug. 15, 2017

(54) PART CORRECTING DEVICE FOR AUTOMOBILE PART

(71) Applicant: Hyundai Motor Company, Seoul (KR)

(72) Inventors: Young Hoon Jang, Whasung-si (KR); Youn Soo Han, Whasung-si (KR); Byung Hun Kim, Whasung-si (KR); Heong Joo Park, Whasung-si (KR)

(73) Assignee: Hyundai Motor Company, Seoul (KR)

( * ) Notice: Subject to any disclaimer, the term of this patent is extended or adjusted under 35 U.S.C. 154(b) by 184 days.

(21) Appl. No.: 14/061,558

(22) Filed: Oct. 23, 2013

(65) Prior Publication Data

US 2015/0020565 A1 Jan. 22, 2015

(30) Foreign Application Priority Data

Jul. 16, 2013 (KR) ..... 10-2013-0083494

(51) Int. Cl.
*B21D 1/12* (2006.01)
*B21D 3/12* (2006.01)
*B21D 11/14* (2006.01)

(52) U.S. Cl.
CPC ..... *B21D 1/12* (2013.01); *B21D 3/12* (2013.01); *B21D 11/14* (2013.01)

(58) Field of Classification Search
CPC ... B21D 1/00; B21D 1/06; B21D 1/08; B21D 1/10; B21D 1/12; B21D 1/14; B21D 1/145; B21D 3/10; B21D 3/12; B21D 5/042; B21D 11/14; B21D 11/15; B21D 11/16; B21D 22/22; B21D 24/08; B21D 24/14; B21D 35/002; B21D 37/08; B21D 37/10; B21D 37/12; B21D 43/003; B21D 53/88
USPC ..... 72/31.01, 31.02, 31.1, 298, 299, 301, 72/305, 306, 371, 381, 394, 395, 399, 72/400, 453.01, 705
See application file for complete search history.

(56) References Cited

U.S. PATENT DOCUMENTS 3,400,567 A * 9/1968 Sirantoine ..... B21D 3/10 72/299
4,036,056 A * 7/1977 Saunders ..... B21D 22/28 72/329
(Continued)

FOREIGN PATENT DOCUMENTS

JP 1-254323 A 10/1989
JP 3-133518 A 6/1991
(Continued)

OTHER PUBLICATIONS

Machine translation of KR 2008-0006367 provided by EPO website (espacenet.com).*

*Primary Examiner* — Peter DungBa Vo
*Assistant Examiner* — Joshua D Anderson
(74) *Attorney, Agent, or Firm* — Morgan Lewis & Bockius LLP

(57) ABSTRACT

A part correcting device for an automobile part may include a body in which the part is disposed, a hydraulic apparatus which presses and fixes one side of the part disposed in the body, a warpage correcting apparatus which corrects a warpage of the part by rotating the other side of the part left or right while fixing the other side of the part disposed in the body, and a deformation correcting apparatus which corrects an angle of the part by pressing flanges formed on both sides of the part downwardly while fixing the flanges.

10 Claims, 8 Drawing Sheets

(56) References Cited

U.S. PATENT DOCUMENTS

| | | | | |
|---|---|---|---|---|
| 5,035,135 | A | 7/1991 | Mäkelä | |
| 5,933,951 | A * | 8/1999 | Bergue | B21D 22/20 29/889.7 |
| 7,147,731 | B2 * | 12/2006 | Tanaka | B21D 53/88 148/574 |
| 2006/0082040 | A1 | 4/2006 | Shimizu et al. | |
| 2010/0116013 | A1 * | 5/2010 | Brennand | B21D 22/02 72/311 |
| 2012/0260712 | A1 * | 10/2012 | Bongratz | B21D 11/14 72/299 |

FOREIGN PATENT DOCUMENTS

| | | | |
|---|---|---|---|
| JP | 2006-320947 | A | 11/2006 |
| JP | 2007-167930 | A | 7/2007 |
| KR | 10-2006-0128610 | A | 12/2006 |
| KR | 10-2008-0006367 | A | 1/2008 |
| KR | 10-1029940 | B1 | 4/2011 |

* cited by examiner

PART CORRECTING DEVICE FOR AUTOMOBILE PART

CROSS-REFERENCE TO RELATED APPLICATION

The present application claims priority of Korean Patent Application Number 10-2013-0083494 filed on Jul. 16, 2013, the entire contents of which application are incorporated herein for all purposes by this reference.

BACKGROUND OF INVENTION

Field of Invention

The present invention relates to a part correcting device for an automobile part, and more particularly, to a part correcting device for an automobile part capable of correcting warpage and deformed portions of an automobile part.

Description of Related Art

In general, an automobile part has warpage and a deformation of a cross-sectional dimension during the manufacturing, and therefore a part correcting device corrects the warpage and the deformed portions of the cross-sectional dimension to improve a precision of the automobile part.

A part correcting device is disclosed in detail in Korean Patent Registration No. 10-0075857 and Korean Patent Laid-Open Publication No. 10-2010-0075214. However, the part correcting device according to the related art has a limitation in accurately correcting the warpage and the deformation of the cross-sectional dimension of the automobile part. Therefore, a need exists for a part correcting device accurately correcting the automobile part.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

Accordingly, the present invention has been made to solve at least some of the above-mentioned problems occurring in the prior art while advantages achieved by the prior art are maintained intact.

Various aspects of the present invention provide for a part correcting device for an automobile part capable of accurately correcting a warpage and a deformation of a cross-sectional dimension of an automobile part.

In various aspects of the present invention, there is provided a part correcting device for an automobile part, including: may include a body in which the part is disposed, a hydraulic apparatus which presses and fixes one side of the part disposed in the body, a warpage correcting apparatus which corrects a warpage of the part by rotating the other side of the part left or right while fixing the other side of the part disposed in the body, and a deformation correcting apparatus which corrects an angle of the part by pressing flanges formed on both sides of the part downwardly while fixing the flanges.

The hydraulic apparatus may include a support member which is fixed to one side of an upper surface of the body by a plurality of guide bars, a first hydraulic cylinder disposed on an upper surface of the support member, and a first fixing member which presses and fixes the one side of the part disposed in the body while descending by the first hydraulic cylinder.

The first fixing member may be provided with a guide plate and the guide plate may be slidably coupled with the plurality of the guide bars to make ends of the guide plate correspond to the guide bars. One side of the upper surface of the body may be provided with a support which supports a bottom surface of the one side of the part. A bottom surface of the guide plate may be provided with a second fixing member and the second fixing member may press and fix the one side of the part together with the first fixing member.

The warpage correcting apparatus may include a warpage correcting body which is disposed on other side of an upper surface of the body with respect to the hydraulic apparatus, a warpage correcting member which is disposed on one surface of the warpage correcting body corresponding to the other side of the part and corrects the warpage by rotating the part left or right while fixing the other side of the part, and a rotating member which is disposed on the other surface of the correcting body and rotates the warpage correcting member left or right.

The warpage correcting member may include a rotating plate which is disposed on the one surface of the correcting body, a support piece which is disposed on a lower portion of one surface of the rotating plate and supports the other side of the part, and a second hydraulic cylinder which is disposed on an upper portion of the one surface of the rotating plate and presses and fixes the other side of the part supported by the support piece.

The rotating member may include a rotating body which is disposed on the other surface of the correcting body, a rotating bar which has one end coupled with the rotating plate through the correcting body and the other end inserted in the rotating body, a pinion which is coupled with the other end of the rotating bar, a rack gear which is meshed with the pinion and rotates the pinion at a time of straight movement, and a third hydraulic cylinder which straightly advances or retreats the rack gear.

The deformation correcting apparatus may include a deformation correcting body which is disposed between the hydraulic apparatus and the warpage correcting apparatus and has a guide hole substantially vertically disposed on a side thereof, a deformation correcting member which is provided with a fixing piece holding and fixing the flanges of the part and a guide piece movably coupled with the guide hole of the deformation correcting body to press the flanges of the part so as to correct an angle, and a fourth hydraulic cylinder which descends the deformation correcting member along the guide hole.

The guide hole may be formed in a curved form. The deformation correcting apparatus may be mounted between the hydraulic apparatus and the warpage correcting apparatus.

In various other aspects of the present invention, there is provided a method for correcting an automobile part, including: disposing the part; fixing one side of the part, correcting a warpage of the part by rotating the part left or right while fixing the other side of the part, and correcting an angle of flanges by pressing the flanges formed on both sides of the part downwardly while fixing the flanges.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Figure 1:
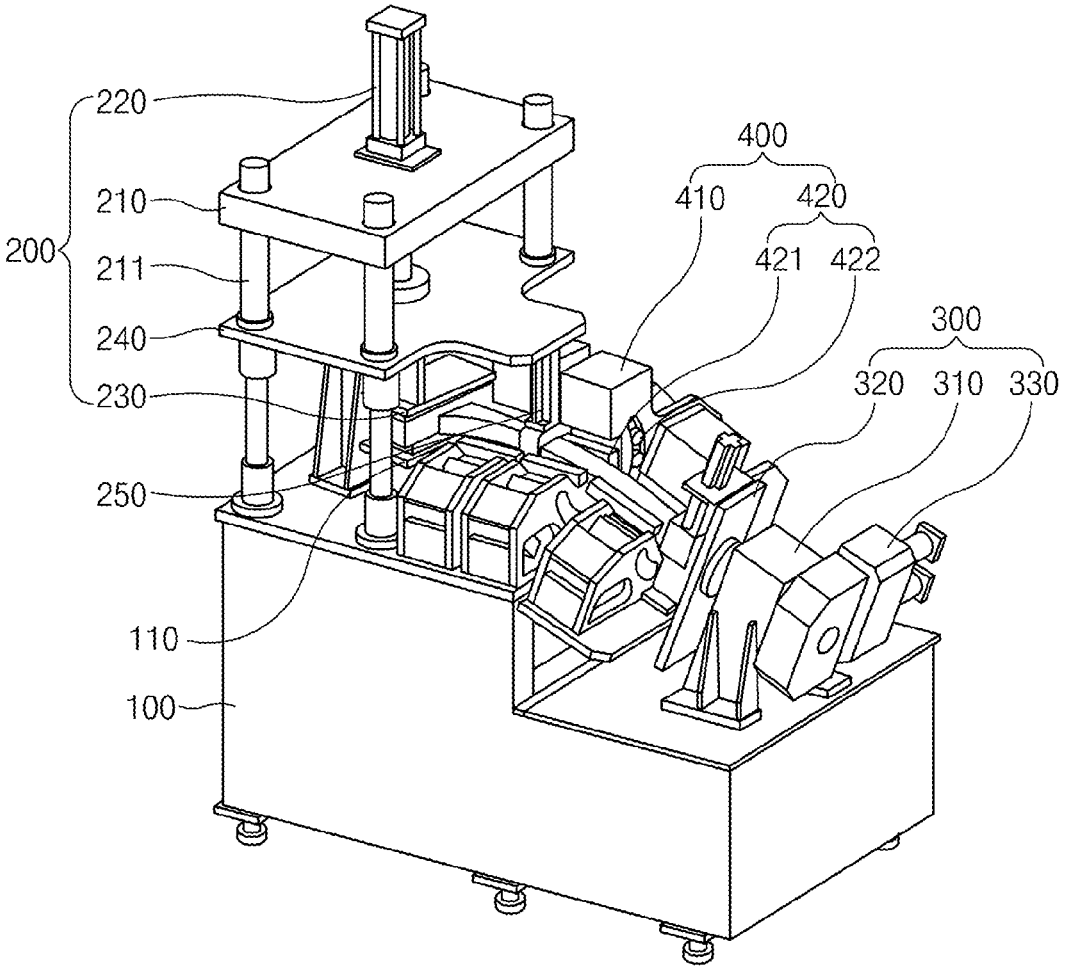
FIG. 1 is an overall perspective view illustrating a part correcting device for an automobile part according to the present invention.

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

A part correcting device for an automobile part according to exemplary embodiments of the present invention is an apparatus which fixes one end of a part disposed in a body by a hydraulic apparatus while fixing the other end of the part by a warpage correcting apparatus, rotates the part left or right, or clockwise/counter-clockwise to correct warpage, and corrects a deformed angle by fixing and pressing flanges disposed at both sides of the part by a deformation correcting apparatus.

Hereinafter, exemplary embodiments of the present invention will be described in detail with reference to the accompanying drawings so that they can be easily practiced by those skilled in the art to which the present invention pertains. However, the present invention may be modified in various different ways and is not limited to the embodiments provided in the present description. In the accompanying drawings, portions unrelated to the description will be omitted in order to obviously describe the present invention, and similar reference numerals will be used to describe similar portions throughout the present specification.

Figure 2:
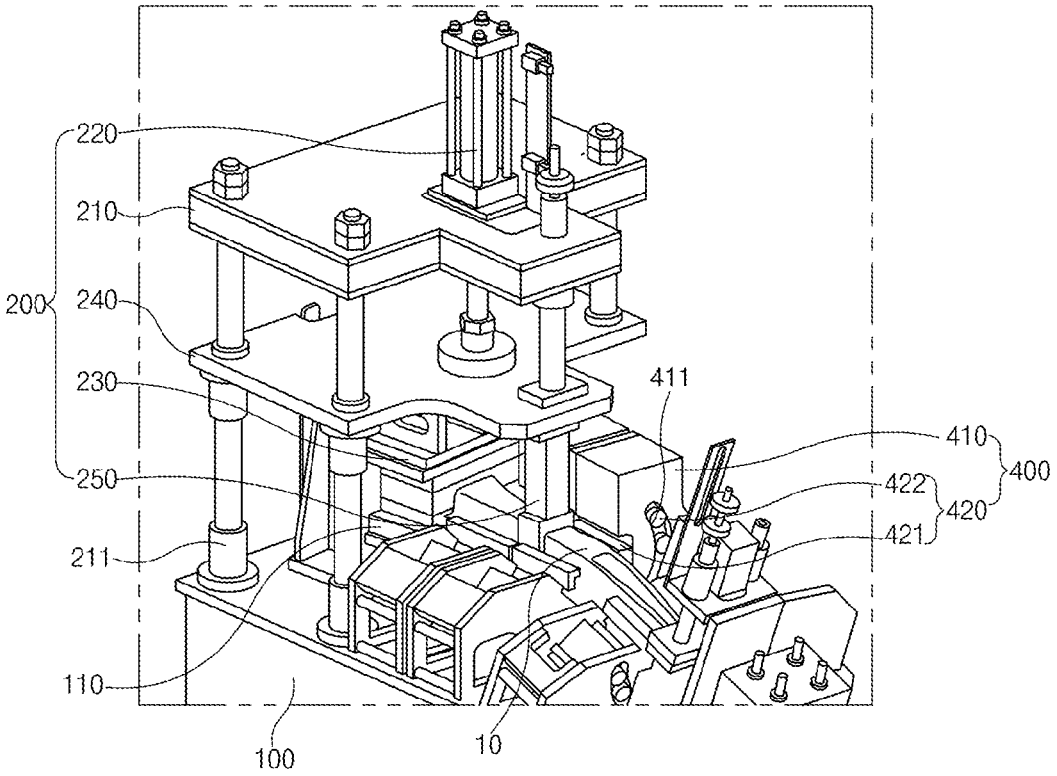
FIG. 2 is a partially enlarged perspective view illustrating the part correcting device for an automobile part according to the present invention.
Figure 4:
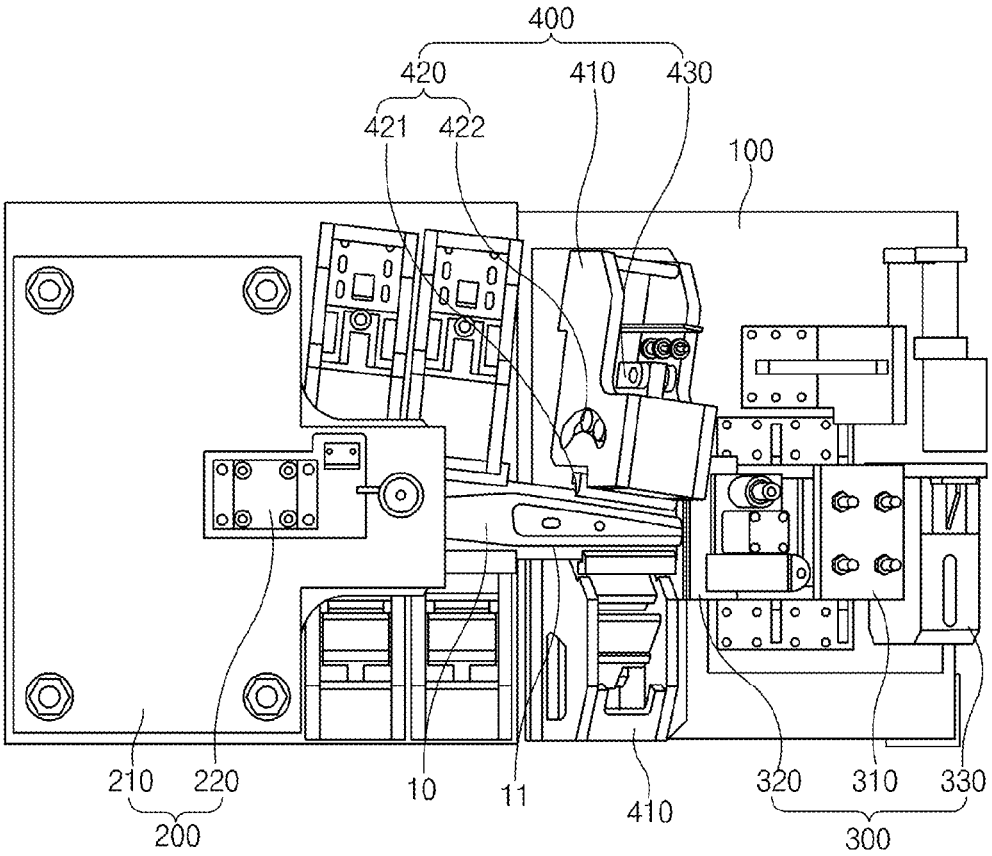
FIG. 4 is a plan view illustrating a warpage correcting apparatus and a deformation correcting apparatus in the part correcting device for an automobile part according to the present invention.
Figure 7:
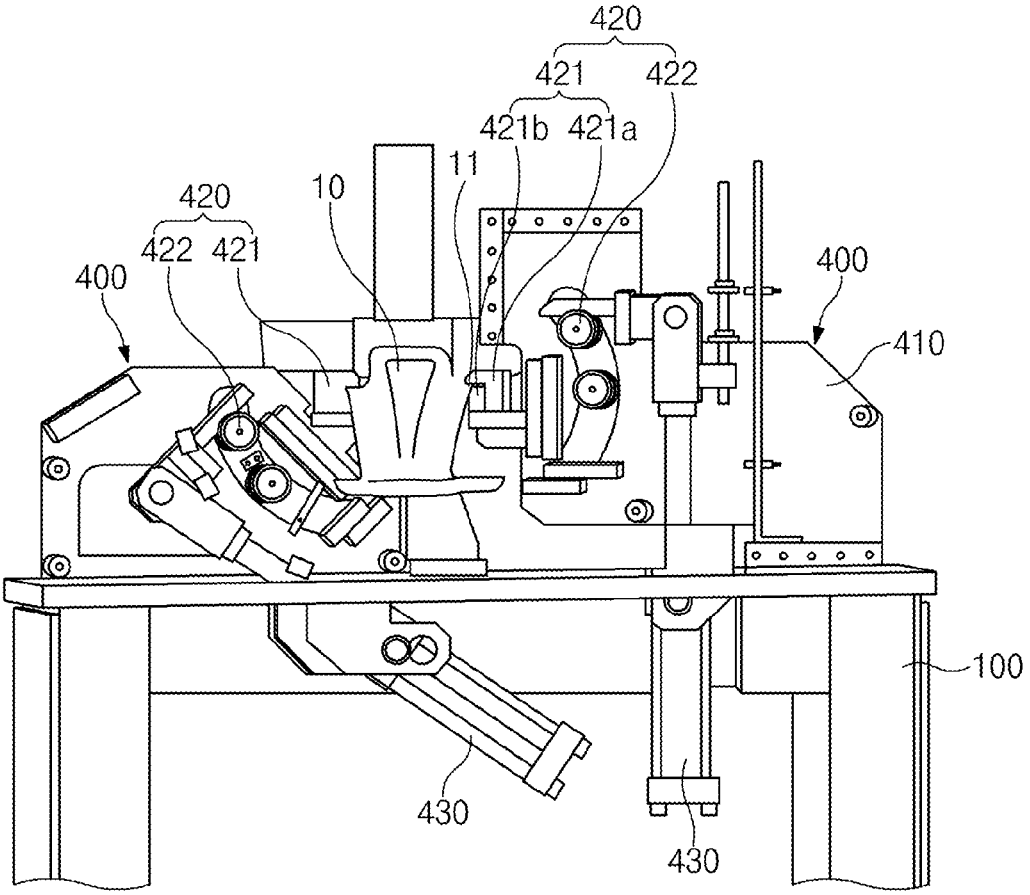
FIG. 7 is a cross-sectional view illustrating the deformation correcting apparatus in the part correcting device for an automobile part according to the present invention.

As illustrated in FIGS. 1 and 2, a part correcting device for an automobile part may include a body 100 in which a part 10 is disposed, a hydraulic apparatus 200 which presses and fixes one side of the part 10 disposed in the body 100, a warpage correcting apparatus 300 which rotates the part 10 left or right, or clockwise/counter-clockwise, to correct a warpage of the part 10 while fixing the other side of the part 10 disposed in the body 100, and a deformation correcting apparatus 400 which corrects an angle of a deformed part pressed downwardly while fixing flanges 11 formed at both sides of the part 10 disposed in the body 100 (FIGS. 4 and 7).

The body 100 is provided with the hydraulic apparatus 200, the warpage correcting apparatus 300, and the deformation correcting apparatus 400 which fix the disposed part 10 and corrects the warpage and the deformation, while disposing the part 10 on an upper surface of the body 100.

In this configuration, as the part 10 disclosed in the exemplary embodiments of the present invention, a center pillar of an automobile part is described as one example and the hydraulic apparatus 200, the warpage correcting apparatus 300, and the deformation correcting apparatus 400 are disposed on the upper surface of the body 100 to fix the center pillar and correct the warpage and the deformation.

Further, one side of the upper surface of the body 100 is provided with a support 110 for supporting one side of the part 10 and the upper surface of the support 110 is provided in a similar or the same form as a bottom form of the part 10 and includes a synthetic resin having elasticity disposed on the upper surface thereof. Therefore, the support 110 stably supports the bottom surface of the part 10.

Figure 3:
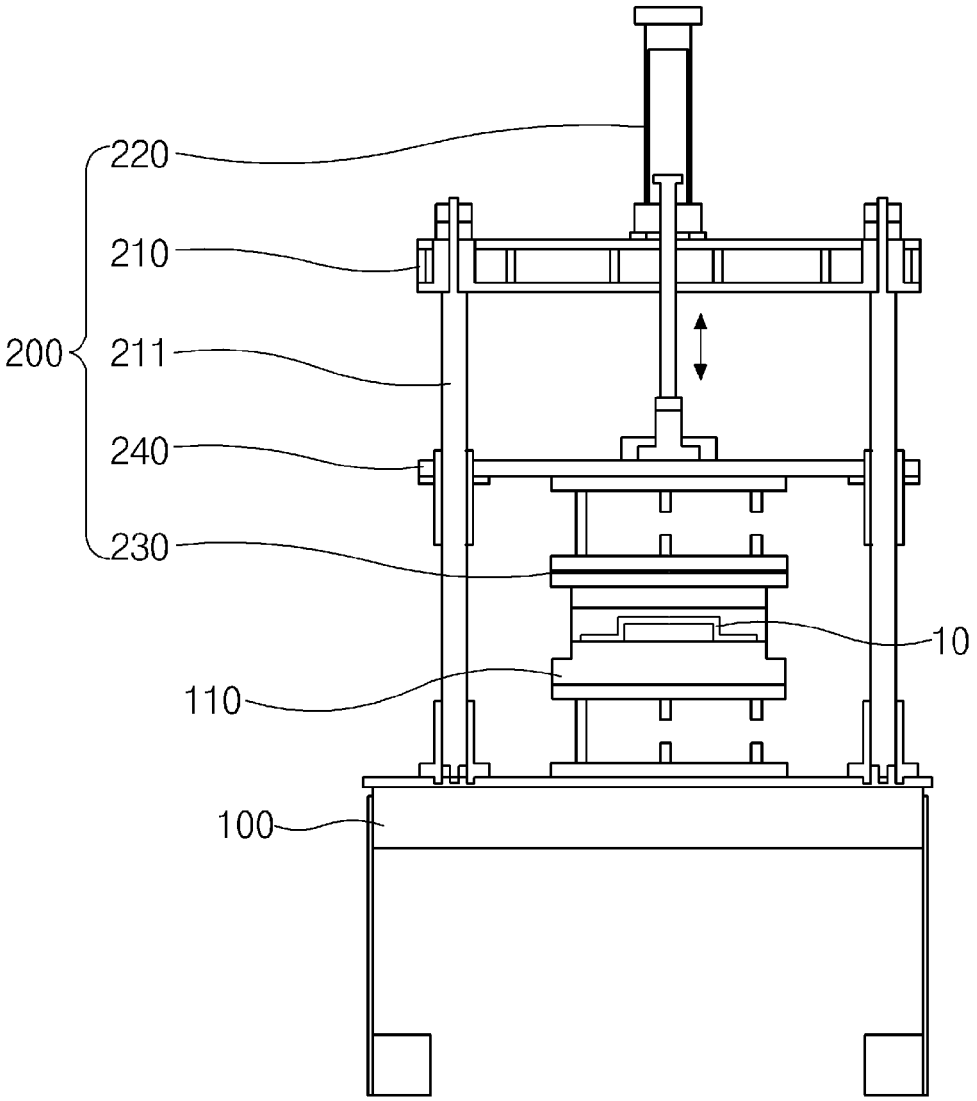
FIG. 3 is a front view illustrating a hydraulic apparatus in the part correcting device for an automobile part according to the present invention.

As illustrated in FIGS. 2 and 3, the hydraulic apparatus 200 is to fix one side of the part 10 disposed in the body 100 to prevent the part 10 from moving and includes a support member 210 fixed to one side of the upper surface of the body 100 by a plurality of guide bars 211, a first hydraulic cylinder 220 disposed on an upper surface of the support member 210, and a first fixing member 230 which presses and fixes one side of the part 10 disposed on the support 110 of the body 100 while descending by a first hydraulic cylinder 220. The support member 210 has a plurality of guide bars 211 vertically fixed to one side of the upper surface of the body 100 and is fixed to the upper surface of the plurality of guide bars 211.

Meanwhile, the first fixing member 230 is provided with a guide plate 240 and the guide plate 240 is slidably coupled with the guide bars 211 so as to make ends of the guide plate 240 correspond to the guide bars 211, such that the first fixing member 230 dose not move in any directions other than slidably moving vertically or substantially vertically.

Meanwhile, a bottom surface of the guide plate 240 is provided with a second fixing member 250 and the second fixing member 250 presses and fixes one side of the part 10 along with the first fixing member 230 to increase a fixing force to the part 10.

When the so configured hydraulic apparatus 200 applies an oil pressure to the hydraulic cylinder 220, the first fixing member 230 descends along with the guide plate 240 while a piston rod of the hydraulic cylinder 220 is drawn out downwardly. In this case, the first and second fixing members 230 and 250 vertically descend along the guide bar 211 by the guide plate 240 to press and fix one side of the part 10 disposed on the support 110. Therefore, the hydraulic apparatus 200 presses and fixes the part 10 in a two-step manner by the first and second fixing members 230 and 250, thereby obtaining the more stable fixing force.

Figure 5:
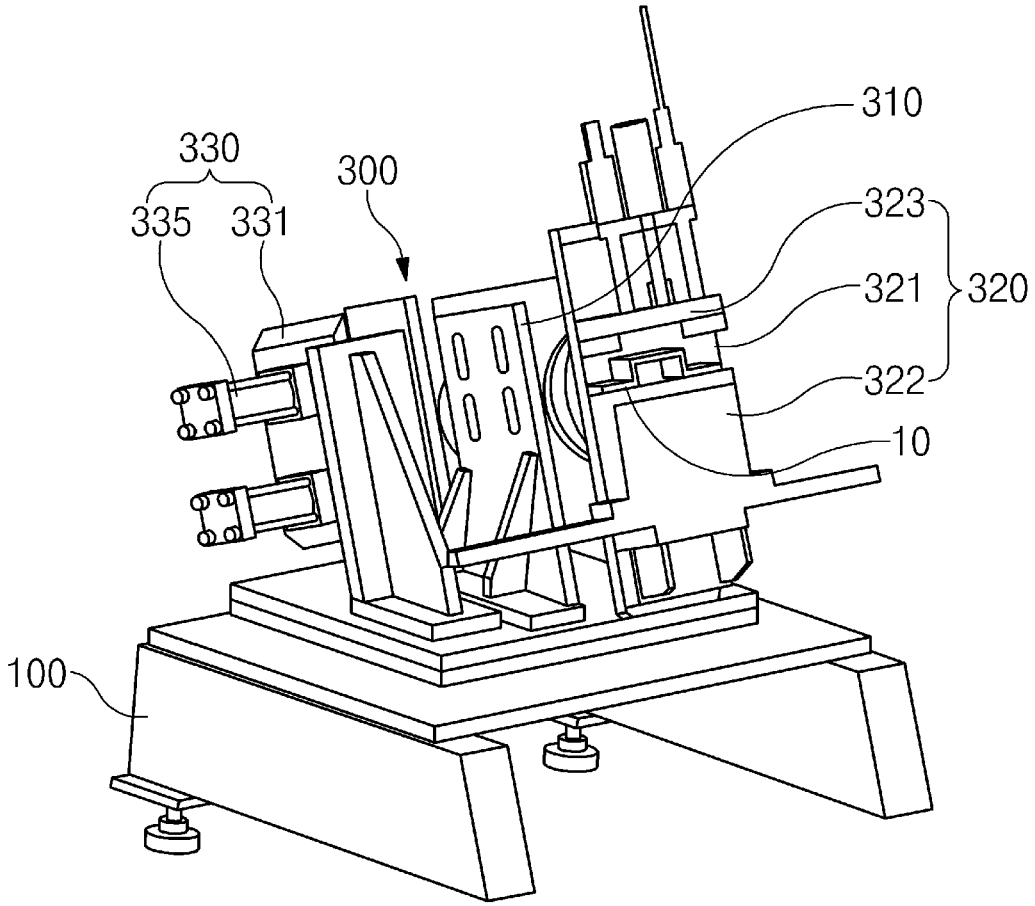
FIG. 5 is a front perspective view illustrating the warpage correcting apparatus in the part correcting device for an automobile part according to the present invention.
Figure 6:
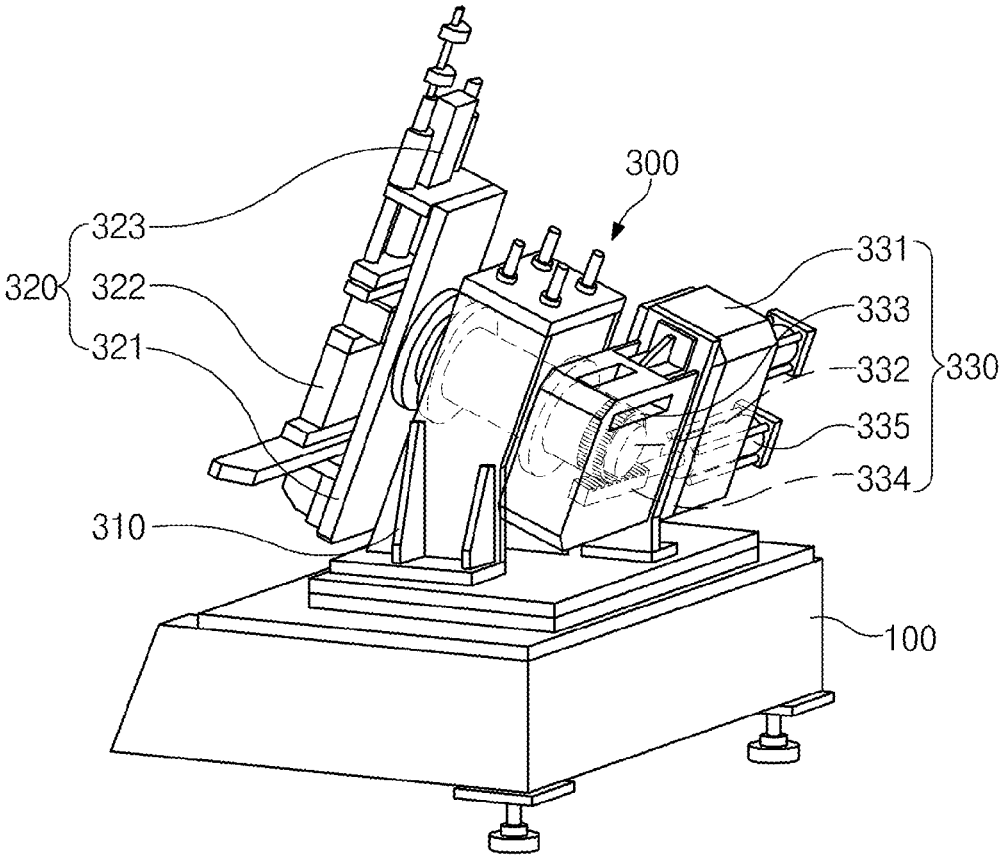
FIG. 6 is a rear perspective view illustrating the warpage correcting apparatus in the part correcting device for an automobile part according to the present invention.

As illustrated in FIGS. 4 to 6, the warpage correcting apparatus 300 is to correct the warped part 10 and includes a warpage correcting body 310 which is disposed on the other side of the upper surface of the body 100, a warpage correcting member 320 which is disposed on one surface of the warpage correcting body 310 corresponding to the other side of the part 10 and fixes the other side of the part 10 and corrects the warpage by rotating the other side of the part left or right, or clockwise/counter-clockwise, and a rotating member 330 which is disposed on the other surface of the warpage correcting body 310 and rotates the warpage correcting member 320 left or right, or clockwise/counter-clockwise.

Referring to FIG. 5, the warpage correcting member 320 includes a rotating plate 321 which is disposed on one surface of the warpage correcting body 310, a support piece 322 which is disposed on a lower portion of the rotating plate 321 and supports the other side of the part 10, and a second hydraulic cylinder 323 which is disposed on the upper portion of one surface of the rotating plate 321 and presses and fixes the other side of the part 10 supported to the support piece 322.

In other words, when the warpage correcting member 320 presses and fixes the other side of the part 10 supported to the support piece 322 by the second hydraulic cylinder 323 and rotates the rotating plate 321 in a direction opposite to a warpage direction of the part 10 in this state, the warpage correcting member 320 corrects the warpage while rotating the other side of the part 10 along with the rotating plate 321.

Meanwhile, the rotating plate 321 of the warpage correcting member 320 may be further provided with a deformation correcting apparatus 400 to be described below, and therefore may correct deformation such as an angle by pressing the flange or flanges of the part 10 fixed to the warpage correcting member 320.

Typically, a deformation correcting apparatus is difficult to be closely mounted to the warpage correcting member 320, such that it is difficult to correct the deformation of the other side of the part 10 close to the warpage correcting member 320. To solve the above problems, the rotating plate 321 of the warpage correcting member 320 is provided with the deformation correcting apparatus 400 to be able to correct an angle by pressing the flanges disposed on the other side of the part 10.

Referring to FIG. 6, the rotating member 330 is to rotate the warpage correcting member 320 left or right and includes a rotating body 331 which is disposed on the other surface of the correcting body 310, a rotating bar 332 of which one end is coupled with the rotating plate 321 through the correcting body 310 and the other end is inserted in the rotating body 331, a pinion 333 which is coupled with the other end of the rotating bar 332, a rack gear 334 which is meshed with the pinion 333 and rotates the pinion 333 at the time of straight movement, and a third hydraulic cylinder 335 which straightly advances or retreats the rack gear 334.

That is, when the rack gear 334 is advanced by the third hydraulic cylinder 335, the rotating member 330 rotates the pinion 333 by the rack gear 334 and rotates the rotating plate 321 by rotating the rotating bar 332 together with the rotation of the pinion 333. Therefore, when the advance distance of the rack gear 334 is adjusted by the third hydraulic cylinder 335, the rotating member 330 may adjust the rotating angle of the rotating plate 321, thereby correcting the warpage of the part 10.

The so configured warpage correcting apparatus 300 corrects the warpage of the part 10 by rotating the warpage correcting member 320 left or right, or clockwise/counter-clockwise by using the rotating member 330, while fixing the other side of the part 10 by using the warpage correcting member 320 fixed to the warpage correcting body 310.

As illustrated in FIGS. 4 and 7, the deformation correcting apparatus 400 is mounted in the body 100 between the hydraulic apparatus 200 and the warpage correcting apparatus 300 which are mounted at both sides of the part 10 to correspond to each other, thereby fixing the flanges disposed at both sides of the part 10 together and correcting the deformation of the part 10.

That is, the deformation correcting apparatus 400 includes a deformation correcting body 410 which is mounted in the body 100 between the hydraulic apparatus 200 and the warpage correcting apparatus 300 and is provided with a guide hole 411 substantially vertically disposed at a side thereof, a deformation correcting member 420 which is provided with a fixing piece 421 holding and fixing the flange 11 of the part 10 and a guide piece 422 movably coupled with the guide hole 411 of the deformation correcting body 410 to press the flange 11 of the part 10 so as to correct an angle, and a fourth hydraulic cylinder 430 which descends the deformation correcting member 420 along the guide hole 411.

In this configuration, the fixing piece 421 holds and fixes the flange 11 of the part 10 by using a pressing plate 421*b* which is press-fitted in the upper surface of the support plate 421*a* by bolt tightening. That is, when the bolt is tightened in the state in which the flange 11 is inserted between the support plate 421*a* and the pressing plate 421*b*, the fixing piece 421 holds and fixes the flange 11 by press-fitting the support plate 421*a* in the pressing plate 421*b*.

Meanwhile, according to the exemplary embodiments of the present invention, the support plate 421*a* is manually press-fitted in the pressing plate 421*b* by a bolt; but the support plate 421*a* and the pressing plate 421*b* may be implemented to be automatically press-fitted by the hydraulic cylinder or a motor according to various other exemplary embodiments of the present invention.

Meanwhile, the guide hole 411 is formed to be vertically curved, such that the deformation correcting member 420 descends inwardly from the outside along the curved guide hole 411 to press the flange 11 folded by a predetermined angle inwardly from below, thereby increasing a correcting force.

When the so configured deformation correcting apparatus 400 holds and fixes the deformed flange 11 of the part 10 to the deformation correcting member 420 and then descends the deformation correcting member 420 through the fourth hydraulic cylinder 430, the deformation correcting member 420 presses the flange 11 of the part 10 while descending along the guide hole 411 of the deformation correcting body 410, such that the deformed part 10 may be corrected to be leveled and the marketability and the precision of the part 10 may increase.

Figure 8:
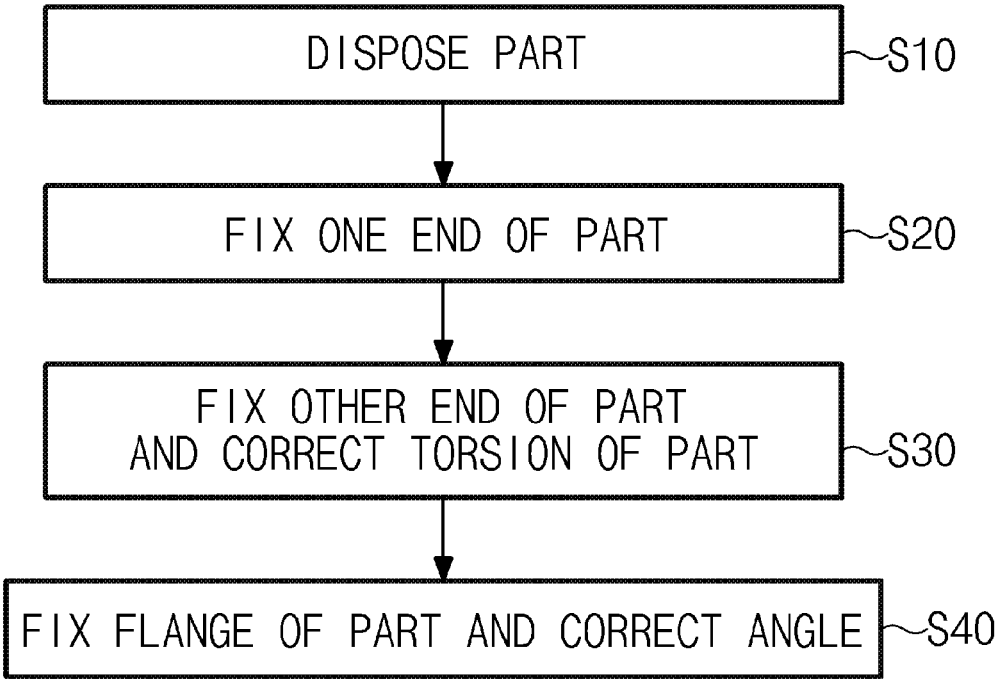
FIG. 8 is a flow chart illustrating a method for correcting a part correcting device for an automobile part according to the present invention.

Hereinafter, a method for correcting a part correcting device for an automobile part according to the exemplary embodiments of the present invention will be described below. That is, as illustrated in FIG. 8, the method for correcting an automobile part according to the exemplary embodiment of the present invention includes disposing a part (S10), fixing one side of the part (S20), correcting the warpage of the part by rotating the part left or right, or clockwise/counter-clockwise while fixing the other side of the part (S30), and correcting the deformed angle of the part pressed downwardly while fixing the flanges disposed on both sides of the part (S40).

As illustrated in FIGS. 1 and 7, in the disposing (S10), one side of the part 10 is disposed on the support 110 of the body 100 and the other side of the part 10 is disposed on the support piece 322 of the warpage correcting member 320 by the warpage correcting apparatus 300. Further, the flanges 11 formed on both sides of the part 10 is disposed between the support part 421*a* and the pressing plate 421*b* of the deformation correcting member 420 by the deformation correcting apparatus 400.

When the disposing (S10) is completed, the fixing of the part 10 (S20) is performed. Referring to FIGS. 1, 2, and 4, in the fixing (S20), the upper surface of one end of the part 10 is pressed and fixed by the hydraulic apparatus 200 and the other side of the part 10 disposed on the fixing piece 322 is pressed by the second hydraulic cylinder 323 to fix the other side of the part 10 to the warpage correcting apparatus 300. Further, the support plate 421*a* is press-fitted in the pressing plate 421*b* to fix the flanges 11 disposed on both sides of the part 10 to the deformation correcting apparatus 400 by bolt tightening.

When the fixing of the part 10 is completed, the correcting of the warpage of the part 10 (S30) is performed. In the correcting of the warpage (S30), the warpage correcting member 320 rotates in a direction opposite to the warpage direction of the part 10 by the rotating member 330 of the warpage correcting apparatus, and therefore the part 10 is corrected at the same angle as one side of the part 10 while the other side of the part 10 rotates together with the warpage correcting member 320, thereby correcting the warpage of the part 10.

When the warpage correction of the part 10 is completed, the correcting of the deformation of the part 10 (S40) is performed. In the correcting of the deformation (S40), when the deformation correcting member 420 descends by the fourth hydraulic cylinder 430, the deformation correcting member 420 presses the flange 11 of the part 10 downwardly while descending along the guide hole 411 of the deformation correcting body 410, such that the part deformed at the predetermined angle is corrected to be leveled.

The method for correcting an automobile part according to the exemplary embodiments of the present invention corrects the warpage and the deformation which occurs during the manufacturing of the part, thereby increasing the precision and marketability of the part.

As set forth above, according to the exemplary embodiments of the present invention, it is possible to accurately correct the warpage and the deformation of the automobile part by using the part correcting device and improve the assembling performance and the marketability of the automobile part.

For convenience in explanation and accurate definition in the appended claims, the terms "left" or "right", "upper" or "lower", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A part correcting device for an automobile part, comprising:

a body in which the automobile part is disposed, the automobile part comprising a first side a and a second side located at opposite ends of a length of the automobile part with flanges running along both sides of the length and connecting the first and second sides of the automobile part;

a hydraulic apparatus configured to press and fix the first side of the automobile part disposed on the body;

a warpage correcting apparatus configured to rotate the second side of the automobile part left or right with respect to the length of the automobile part while fixing the second side of the automobile part disposed in the body so as to correct a warpage of the automobile part; and a deformation correcting apparatus configured to press the flanges formed on both sides of the automobile part downwardly while fixing the flanges so as to correct an angle of the automobile part wherein the hydraulic apparatus includes a support member which is fixed to one side of an upper surface of the body by a plurality of guide bars, a first hydraulic cylinder disposed on an upper surface of the support member, and a first fixing member which presses and fixes the first side of the automobile part disposed in the body while descending by the first hydraulic cylinder.

2. The part correcting device for an automobile part of claim 1, wherein the first fixing member is provided with a guide plate and the guide plate is slidably coupled with the plurality of the guide bars to make ends of the guide plate correspond to the guide bars.

3. The part correcting device for an automobile part of claim 2, wherein a bottom surface of the guide plate is provided with a second fixing member and the second fixing member is configured to press and fix the first side of the automobile part together with the first fixing member.

4. The part correcting device for an automobile part of claim 1, wherein one side of the upper surface of the body is provided with a support which supports a bottom surface of the first side of the automobile part.

5. The part correcting device for an automobile part of claim 1, wherein the warpage correcting apparatus includes a warpage correcting body which is disposed on an other side of an upper surface of the body with respect to the hydraulic apparatus, a warpage correcting member which is disposed on one surface of the warpage correcting body corresponding to the second side of the automobile part and corrects the warpage by rotating the automobile part left or right with respect to the length of the automobile part while fixing the second side of the automobile part, and a rotating member which is disposed on an other surface of the warpage correcting body with respect to the one surface and is configured to rotate the warpage correcting member left or right with respect to the length of the automobile part.

6. The part correcting device for an automobile part of claim 5, wherein the warpage correcting member includes a rotating plate which is disposed on the one surface of the warpage correcting body, a support piece which is disposed on a lower portion of one surface of the rotating plate and supports the second side of the automobile part, and a second hydraulic cylinder which is disposed on an upper portion of the one surface of the rotating plate and is configured to press and fix the second side of the automobile part supported by the support piece.

7. The part correcting device for an automobile part of claim 5, wherein the rotating member includes a rotating body which is disposed on the other surface of the warpage correcting body, a rotating bar which has one end coupled with the rotating plate through the correcting body and the other end inserted in the rotating body, a pinion which is coupled with the other end of the rotating bar, a rack gear which is meshed with the pinion and is configured to rotate the pinion at a time of straight movement, and a third hydraulic cylinder which is configured to straightly advance or retreat the rack gear.

8. The part correcting device for an automobile part of claim 1, wherein the deformation correcting apparatus includes a deformation correcting body which is disposed between the hydraulic apparatus and the warpage correcting apparatus and has a guide hole substantially vertically disposed on a side thereof, a deformation correcting member which is provided with a fixing piece holding and fixing the flanges of the automobile part and a guide piece movably coupled with the guide hole of the deformation correcting body to press the flanges of the part so as to correct the angle of the automobile part, and a fourth hydraulic cylinder which descends the deformation correcting member along the guide hole.

9. The part correcting device for an automobile part of claim 8, wherein the guide hole is formed in a curved form.

10. The part correcting device for an automobile part of claim 1, wherein the deformation correcting apparatus is mounted between the hydraulic apparatus and the warpage correcting apparatus.

* * * * *